US005260751A

United States Patent [19]

Inomata

[11] Patent Number: 5,260,751

[45] Date of Patent: Nov. 9, 1993

[54] IMAGE FORMING APPARATUS WITH VARIABLE SPEED RECORDING MATERIAL CARRYING MEANS

[75] Inventor: Mitsugu Inomata, Kawasaki, Japan

[73] Assignee: Canon Kabushiki Kaisha, Tokyo, Japan

[21] Appl. No.: 942,814

[22] Filed: Sep. 10, 1992

[30] Foreign Application Priority Data

Oct. 9, 1991 [JP] Japan ..... 3-290898

[51] Int. Cl.[5] ..... G03G 15/14; G03G 15/20

[52] U.S. Cl. ..... 355/271; 355/282; 355/326 R

[58] Field of Search ..... 355/204, 208, 271, 273, 355/277, 281, 282, 285, 290, 295, 326, 327

[56] References Cited

U.S. PATENT DOCUMENTS 4,549,803 10/1985 Ohno et al. ..... 355/290 X
4,593,992 6/1986 Yoshinaga et al. ..... 355/285 X
4,941,021 7/1990 Uchida et al. ..... 355/285

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An image forming apparatus which can change its transfer drum speed includes an image bearing member for bearing a toner image, a transfer drum for moving while carrying a recording medium, a rotating fixing member having first and second fixing speeds, and a driving member for the transfer drum for varying the moving speed of the transfer drum (after the completion of an image transfer operation) in accordance with the fixing speed.

11 Claims, 7 Drawing Sheets

IMAGE FORMING APPARATUS WITH VARIABLE SPEED RECORDING MATERIAL CARRYING MEANS

BACKGROUND OF THE INVENTION

1. Field of the Invention

This invention relates to an image forming apparatus in which, after forming an unfixed image on a recording material carried by a recording-material carrying member (such as a transfer drum or the like), the image on the recording material, separated from the recording-material carrying member, is fixed.

2. Description of the Related Art

Recently, in accordance with an increasing demand for color image forming apparatuses, a method has been adopted in which, after sequentially transferring multiple images onto a recording material carried by a transfer drum, the images are simultaneously (at one time) fixed.

In an approach proposed in U.S. Pat. No. 4,549,803, the fixing speed is changed in accordance with the detected type of the recording material so that fixability is invariable irrespective of the properties of the recording material.

For example, when forming an image on an OHP (overhead projector) sheet comprising a resin film, the fixing speed is reduced to about half that of ordinary paper so that the fixing time is doubled.

FIG. 8 is a cross-sectional view of a full-color copier which includes a transfer drum, which can change its fixing speed, and which therefore provides the background of the present invention.

A copier 1 includes a photosensitive drum (an image bearing member) 2 which rotates in the direction of arrow R1, and a charging unit 3, a developing device 6 comprising developing units 6M, 6C, 6Y and 6BK for magenta, cyan, yellow and black toners, respectively, and a cleaning unit 7, sequentially disposed in the direction of the rotation of the photosensitive drum 2.

After an exposure unit 5 sequentially forms electrostatic latent images corresponding to respective colors on the photosensitive drum 2 charged by the charging unit 3, the developing unit 6 sequentially forms toner images.

The toner images are sequentially transferred onto a printing medium P wound around a transfer drum (transfer member) 9. The printing medium P is accomodated in a paper-feeding cassette 10 provided at a lower portion of the image forming apparatus, and is supplied to the transfer drum 9 via a paper-feeding roller 11, registration rollers 12 and a pressing roller 13. The leading-end portion of the supplied printing medium P is grasped by a gripper (not shown) of the transfer drum 9, and the entirety of the printing medium P is wound around the surface of the transfer drum 9 by an electrostatic force. The toner images are sequentially transferred onto the printing medium P at a transfer position M1. That is, a single-color toner image is transferred onto the printing medium P at the transfer position M1 at every rotation of the photosensitive drum 2. Four full-color toner images are transferred onto the printing medium P by four rotations of the photosensitive drum 2. The leading-end portion of the printing medium P on which the images have been transferred is released from the gripper, and a separation charger (a separation unit) 15 separates the printing medium P from the photosensitive drum 2 at a separation position M2 facing the separation charger 15. The printing medium P separated from the transfer drum 9 is guided to a fixing unit 17 by a conveying unit 16 including a conveying belt **16*a* rotatable in the direction of arrow R3**.

A pair of fixing rollers **17*a* rotating in the direction of arrow R5 are provided in the fixing unit 17. The toner images on the printing medium P are mixed and fixed on the printing medium P as a full-color image by a sufficient pressure of the pair of fixing rollers 17*a* and by heating the medium P. The printing medium P on which the toner images have been fixed is discharged onto a paper-discharge tray 20 by paper-discharging rollers 19**.

The above-described fixing operation of the toner images is performed at a fixing speed which differs in accordance with the properties of the printing medium P. For example, if the printing medium P comprises a thick film, such as an OHP sheet, it is necessary to sufficiently press and heat the toner images. For that purpose, the fixing time is elongated by reducing the fixing speed. The fixing speed is reduced by reducing the rotating speed of the fixing rollers **17*a***.

When the fixing speed is reduced in such an apparatus, in order to prevent the occurrence of deviations between toner images or corrugation in the printing paper P caused by a speed difference between the transfer drum 9 and the pair of fixing rollers **17*a*, the distance Ls between the separation position M2 (where the printing medium P is separated from the transfer drum 9) and the fixing position (which is at a nip of the pair of fixing rollers 17*a***) is set to be longer than the maximum length of the used printing medium P.

This hinders a reduction of the size of the copier 1. Furthermore, since a conveying force is not provided to the printing medium P until the printing medium P reaches the fixing unit 17 after leaving the transfer drum 9, it is necessary to provide the conveying unit 16 between the transfer drum 9 and the pair of fixing rollers **17*a***.

SUMMARY OF THE INVENTION

It is an object of the present invention to provide an image forming apparatus in which the distance between a separation position, where a recording material is separated from a recording-material carrying member, and a fixing position is shortened.

It is a further object of the present invention to provide an image forming apparatus in which it is unnecessary to provide a conveying unit between a recording-material carrying member and fixing means.

It is a still further object of the present invention to provide an image forming apparatus which can reduce the moving speed of a recording-material carrying member after the completion of image formation on a recording material carried on the recording-material carrying member.

It is still another object of the present invention to provide an image forming apparatus which can change the moving speed of a recording-material carrying member in accordance with the fixing speed after the completion of an image transfer operation.

These and other objects, advantages and features of the present invention will become more apparent from the following description of the preferred embodiments taken in conjunction with the accompanying drawings.

According to a first aspect of the present invention, an image forming apparatus comprises a recording-medium carrying member rotating while carrying a recording medium. Image forming means are provided for forming an image on the recording medium carried by said recording-medium carrying member. Driving means are provided for driving the recording-medium carrying member at a first circumferential speed while the image is formed. Fixing means are provided for fixing the image on the recording medium, the fixing means being capable of fixing the image at a fixing speed which is lower than the first circumferential speed. After the image has been formed on the recording medium, the driving means drives the recording-medium carrying means at a second circumferential speed which is lower than the first circumferential speed.

According to another aspect of the present invention, an image forming apparatus comprises an image bearing member for bearing an undeveloped image. A recording-medium carrying member is provided for moving while carrying a recording medium, the undeveloped image on the image bearing member being transferred onto the recording medium carried by the recording-medium carrying means. Fixing means are provided for fixing the image on the recording medium, the fixing means being capable of performing a fixing operation at a first fixing speed and a fixing operation at a second fixing speed different from the first fixing speed. The moving speed of the recording-medium carrying member after the completion of the transfer operation differs between the fixing operation at the first fixing speed and the fixing operation at the second fixing speed.

DESCRIPTION OF THE PREFERRED EMBODIMENTS

Preferred embodiments of the present invention will now be explained with reference to the drawings.

FIRST EMBODIMENT

Figure 1:
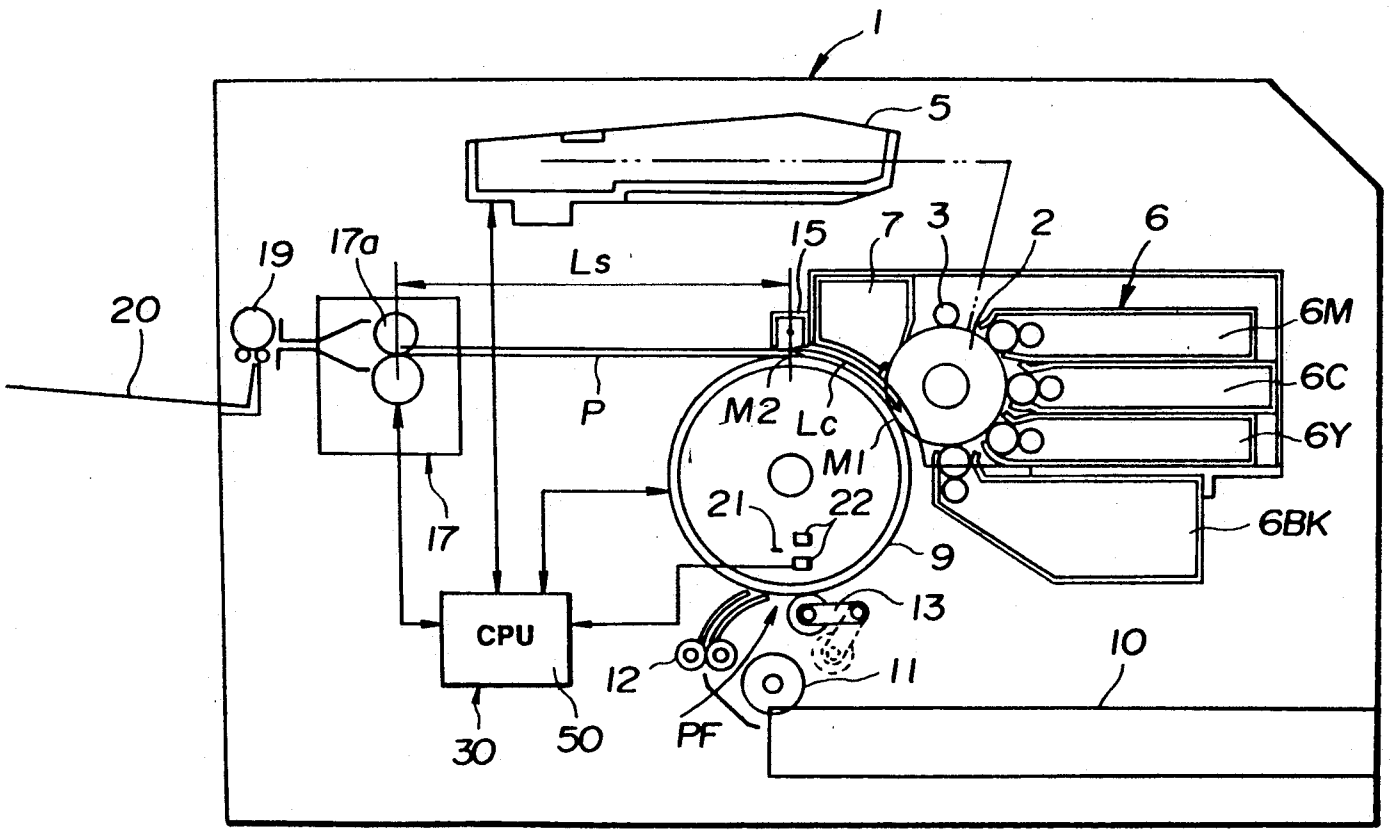
FIG. 1 is a cross-sectional view of an image forming apparatus according to a first embodiment of the present invention.
Figure 2:
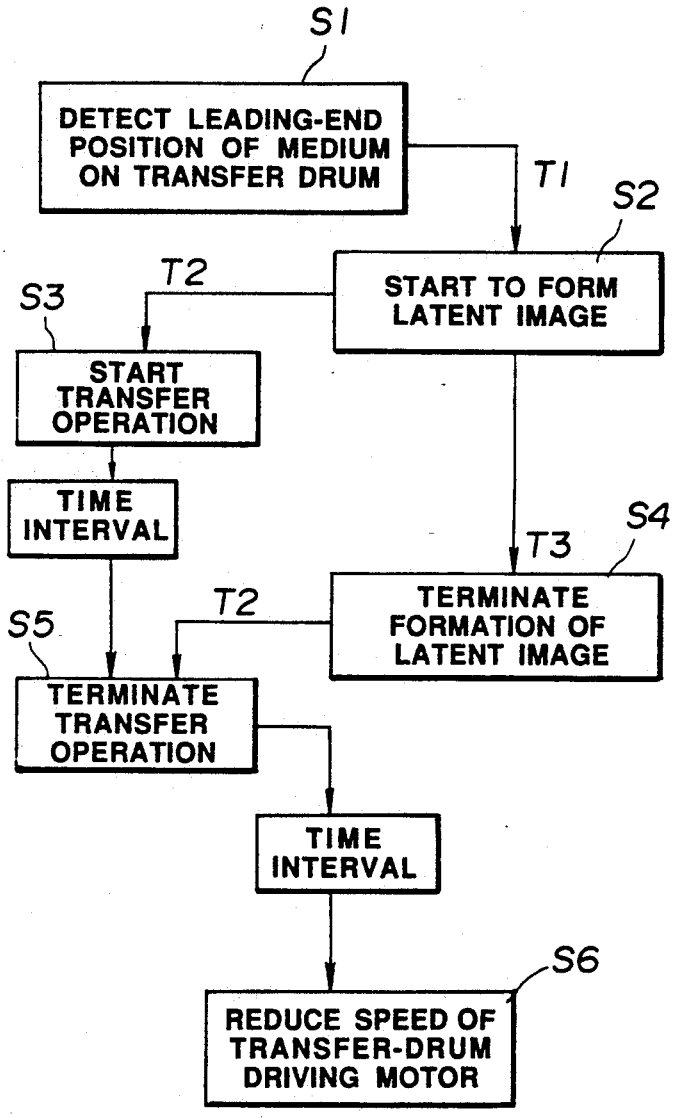
FIG. 2 is a flowchart showing the operation of the first embodiment.
Figure 3:
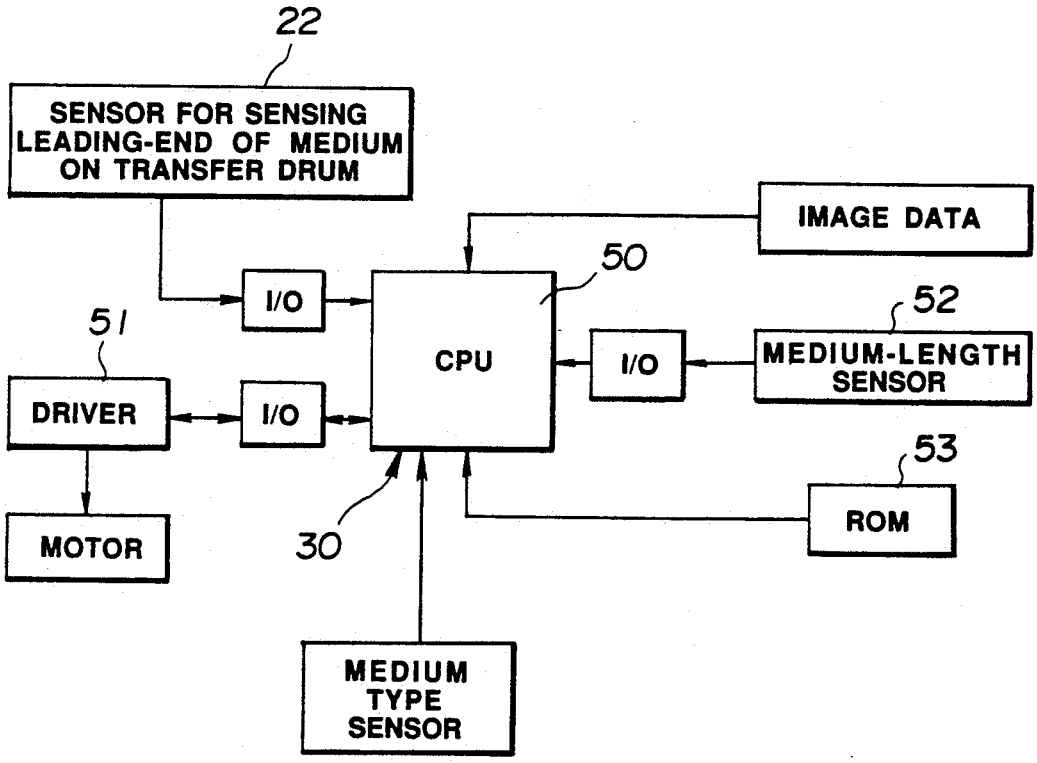
FIG. 3 is a block diagram showing the configuration of the first embodiment.
Figure 8:
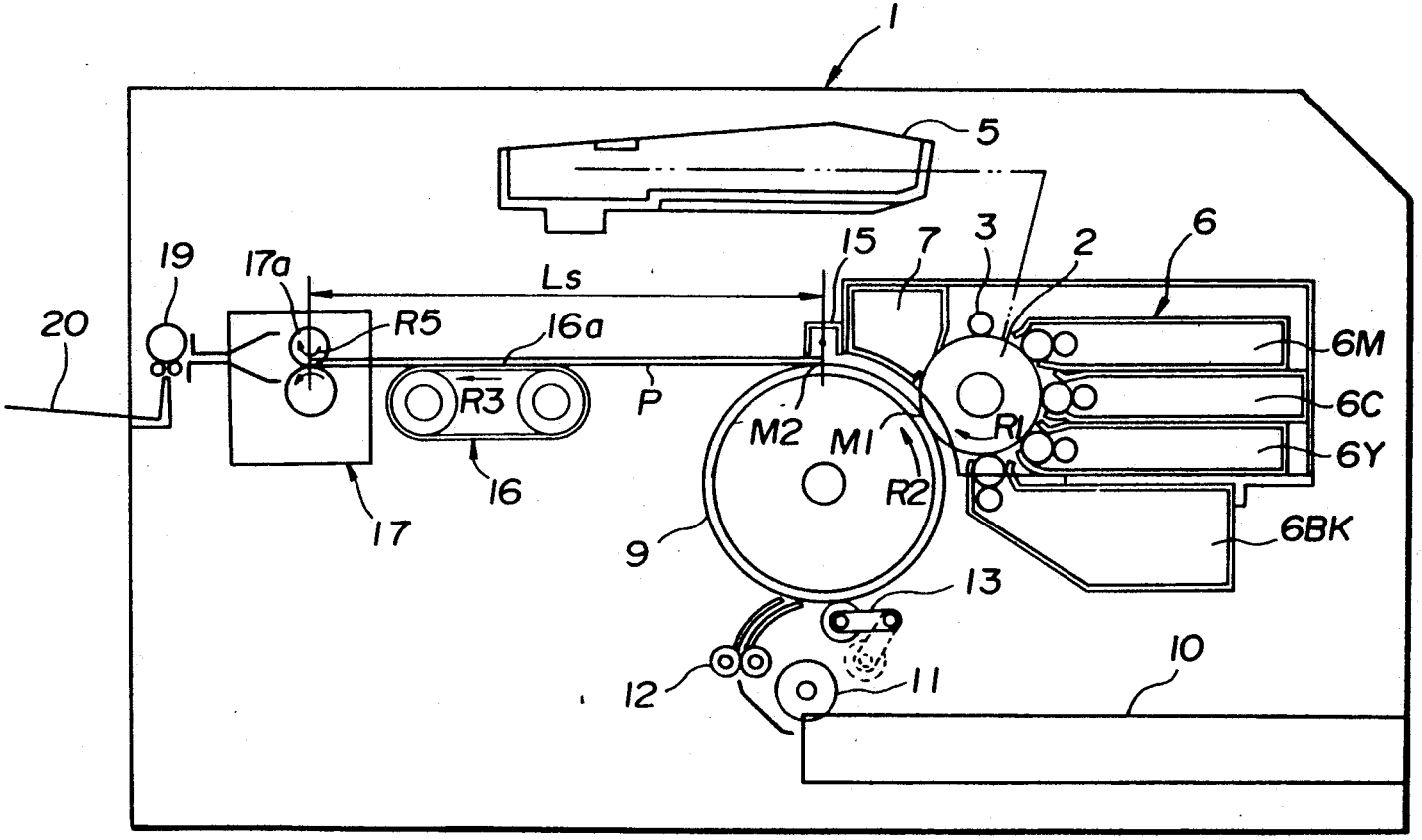
FIG. 8 is a cross-sectional view of an image forming apparatus which serves as the background of the present invention.

A first embodiment of the present invention will be explained with reference to FIGS. 1 through 3. In FIGS. 1 through 3, components having the same configuration and functions as those shown in FIG. 8 are indicated by the same reference numerals, and a further explanation thereof will be omitted.

As shown in FIG. 1, a toner image on the image bearing member 2 is transferred onto the printing medium P, serving as the recording material, in a state in which the leading end of the printing medium P is held by a gripper (not shown), and remaining portions of medium P are electrostatically attracted on the outer circumference of the transfer drum (transfer member) 9. A leading-end-position-of-medium detection member 21 is provided in the transfer drum 9 at a position corresponding to the leading end of an image-writable region on the printing medium P held by the gripper. A leading-end-of-medium sensor 22 for detecting the leading-end-position-of-medium detection member 21 is provided at the side of the main body of the copier 1. A control device 30 is connected to the exposure unit 5, the transfer drum 9, the pair of fixing rollers 17*a* and the like, and is also connected to the leading-end-of-medium sensor 22. The control device 30 controls both the rotating speed of the transfer drum 9 and the fixing speed of the fixing unit 17.

The fixing speed is a conveying speed of the printing medium P conveyed by the pair of fixing rollers 17*a*, and equals the conveying speed of the printing medium P transferred from the transfer drum 9.

The printing medium P is supplied from the paper feeding cassette 10 to the transfer drum 9 by the paper feeding roller 11, the registration rollers 12, the pressing roller 13 and the like. The leading end of the printing medium P is held by the gripper of the transfer drum 9, and the entirety of the printing medium P is held in close contact with the surface of the transfer drum 9 by an electrostatic force. At that time, the position of the leading end of the printing medium P is exactly aligned with the position of the leading-end-position-of-medium detection member 21.

If the leading-end-position-of-medium detection member 21 reaches the leading-end-of-medium sensor 22 as a result of rotation of the transfer drum 9, the leading-end-of-medium sensor 22 detects the leading-end-position-of-medium detection member 21, that is, the leading end of the printing medium P (step S1 in FIG. 2), and a signal indicating the detection is input to a CPU (central processing unit) 50 of the control device 30. Subsequently, in order to form an image at a predetermined position of the printing medium P in accordance with image data, the exposure unit 5 starts to form a latent image on the image bearing member 2 after T1 seconds (step S2). When a position on the printing medium P which is to be the leading end of the image reaches the contact portion M1 between the transfer drum 9 and the image bearing member 2, the toner image on the image bearing member 2 also reaches that position, and an image transfer operation is started at T2 seconds after the start of the formation of the latent image (step S3). The formation of the latent image is completed in T3 seconds corresponding to the time of the formation of the latent image for the length of the image (step S4), and the image transfer operation is completed in T2 seconds thereafter (step S5). Since the time intervals T1 and T3 can be calculated from image data and the time interval T2 is constant, the CPU 50 outputs a signal indicating the reduction of the speed of a transfer-drum driving motor (not shown) at (T1+T2+T3) seconds after the detection by the leading-end-of-medium sensor 22 to a driver 51 for the motor, whereby the circumferential speed of the transfer drum 9 is reduced in accordance with the fixing speed (step S6).

Since the circumferential speed of the transfer drum 9 is reduced in accordance with the fixing speed after the completion of the transfer operation, no problem arises even if a conveying force is applied to the printing medium P from both the transfer drum 9 and the pair of fixing rollers 17*a*.

Accordingly, it is possible to shorten the distance Ls between the separation position M2 and the fixing position by bringing the fixing unit 17 closer to the separation charger 15 by a distance Lc corresponding to the distance between the transfer position M1 and the separation position M2. That is, while in the apparatus shown in FIG. 8, the distance Ls between the separation position M2 and the fixing position is longer than the maximum length L1 of the used printing medium P, in the present embodiment, the distance Ls between the separation position M2 and the fixing position can be set to Ls=L1−Lc. Hence, if the length of the printing medium P is longer than the distance Ls between the separation position and the fixing position, the printing medium P can be conveyed with no problem and without providing a particular conveying unit between the transfer drum 9 and the fixing unit 17. However, the length of a region of electrostatic attraction required for conveying the printing medium P after separation is added to the distance Ls between the separation position and the fixing position.

SECOND EMBODIMENT

Figure 4:
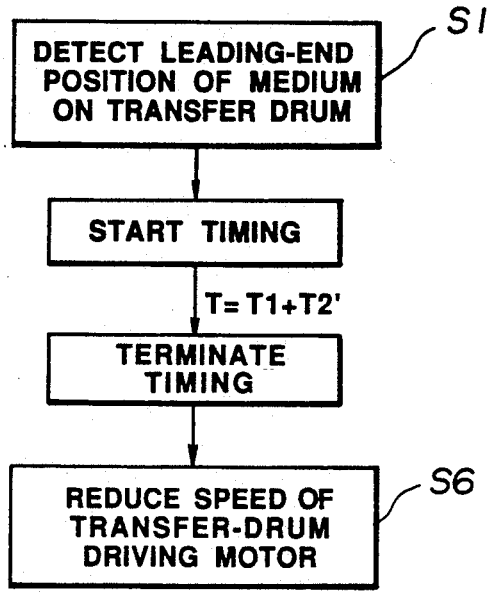
FIG. 4 is a flowchart showing the operation of a second embodiment of the present invention.

FIG. 4 is a flowchart showing the operation of a second embodiment of the present invention. After the detection of the leading-end position of the printing medium P on the transfer drum 9 (step S1), if a time obtained by adding a time T2′ (required for the transfer drum 9 to rotate a distance corresponding to the length of the printing medium P detected by a medium-length sensor 52 (FIG. 3) provided at the paper-feeding portion PF (FIG. 1)) to a time T1 (required for the leading end of the printing medium P to reach the transfer position M1) has elapsed, the circumferential speed of the transfer drum 9 is reduced in accordance with the fixing speed.

THIRD EMBODIMENT

Figure 5:
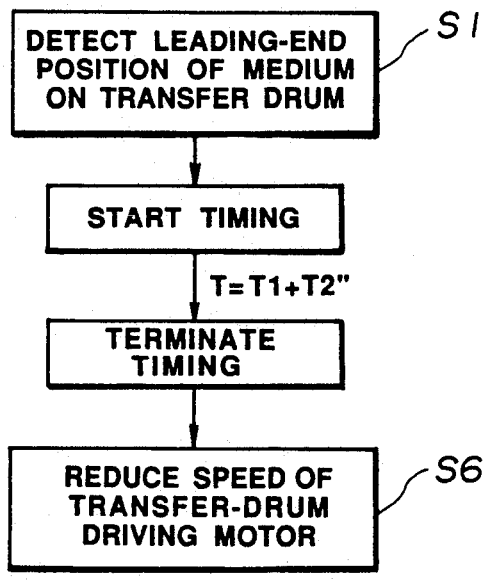
FIG. 5 is a flowchart showing the operation of a third embodiment of the present invention.

FIG. 5 is a flowchart showing the operation of a third embodiment of the present invention. After the detection of the leading-end position of the printing medium P on the transfer drum (step S1), if a time obtained by adding a time T2″ (required for the transfer drum 9 to rotate a distance between the leading end of the longest length of a low-speed-fixing printing medium P and the final end of a printable region (an image-writing region) of medium P) to a time T1 (required for the leading end of the printing medium P to reach the transfer position M1) has elapsed, the circumferential speed of the transfer drum 9 is reduced in accordance with the fixing speed. Since the value of the time T2″ is constant depending on the medium specifications of the copier 1, the value is stored in the ROM 53 (FIG. 3).

FOURTH EMBODIMENT

Figure 6:
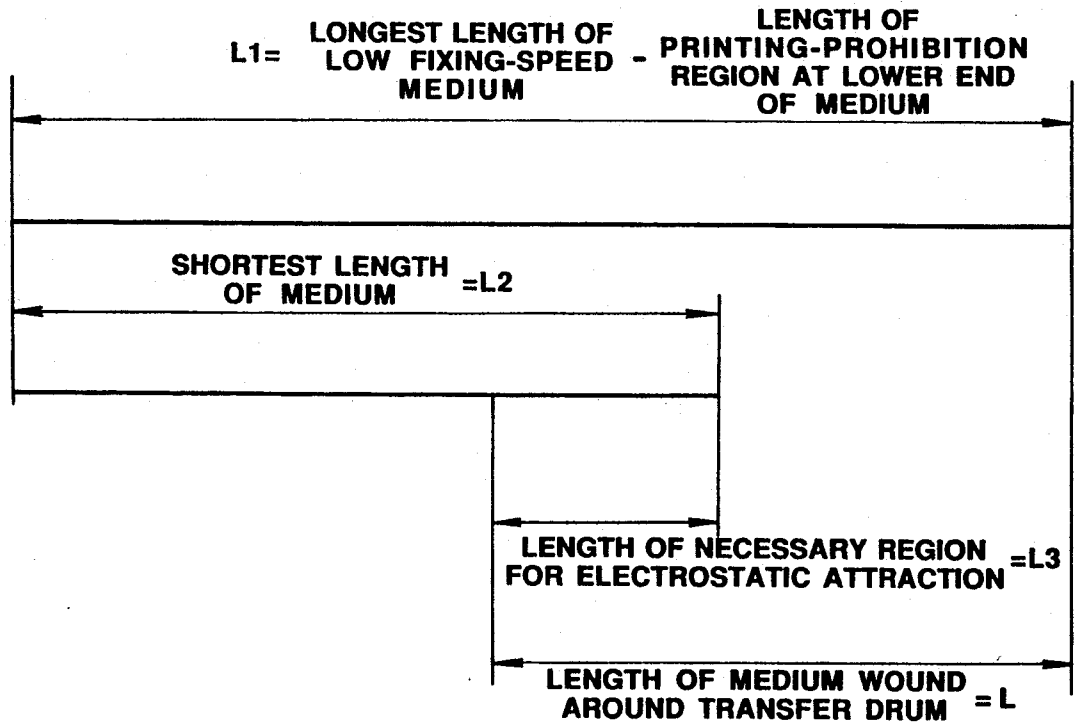
FIG. 6 is a diagram illustrating the relationship between the length of a printing medium and the length of a transfer drum in a fourth embodiment of the present invention.
Figure 7:
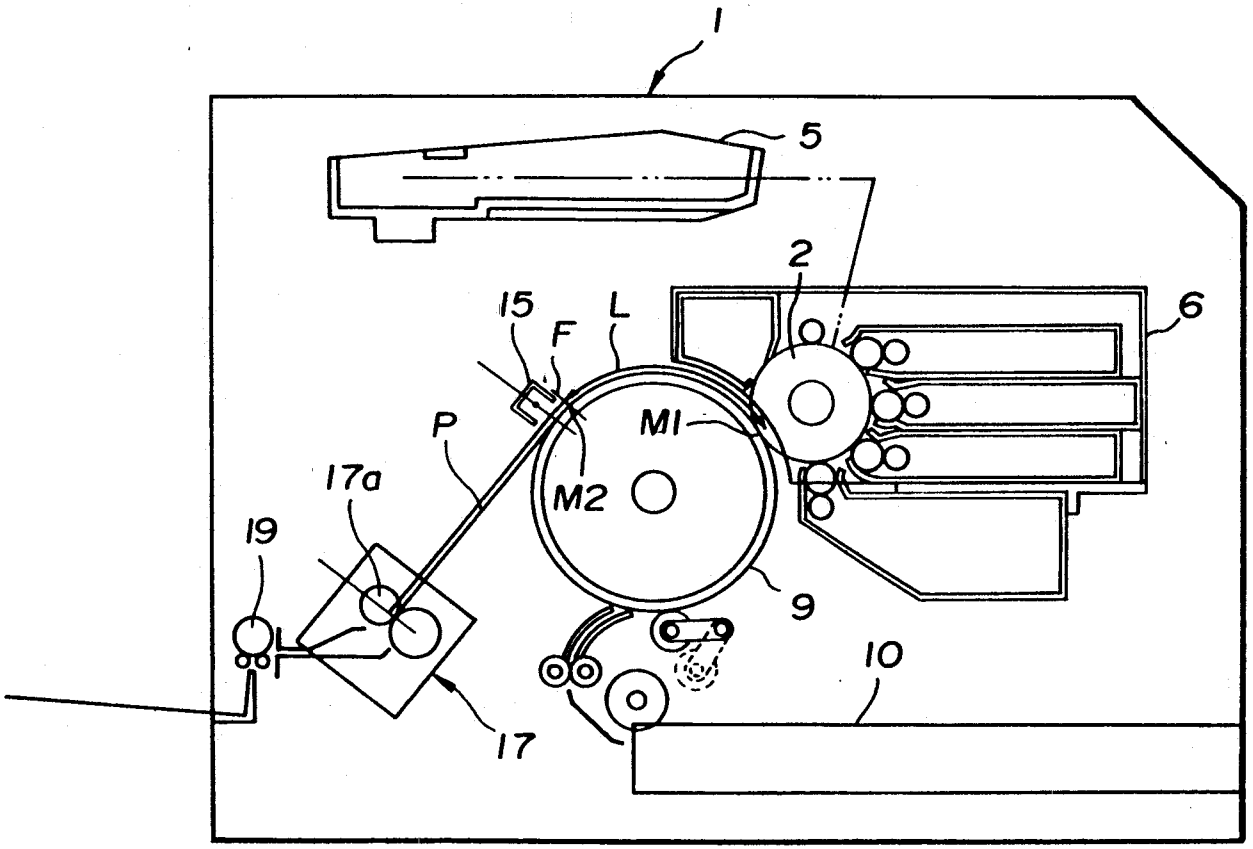
FIG. 7 is a cross-sectional view of an image forming apparatus of the fourth embodiment.

FIGS. 6 and 7 illustrate a fourth embodiment of the present invention. The separation position M2 of the printing medium P from the transfer drum 9 equals the position of the border F of the charge-removing region of the separation charger 15 at the upstream side. Border F is separated by a distance L from the transfer position M1 between the transfer drum 9 and the photosensitive drum 2. The length L is expressed by L=L1−L2−L3, where L1 is the distance between the leading end of the longest length of the low-speed-fixing medium and the final end of the printable region (image writing region), L2 is the length of the shortest length of the medium which can be used in the apparatus, and L3 is the length of the electrostatic-attraction region at the rear-end portion to which the printing medium P can be conveyed when the leading-end side of the shortest medium is separated. As shown in FIG. 7, by configuring the apparatus so that the distance between the transfer position M1 on the transfer drum 9 and the separation position M2 of the printing medium P equals L, it becomes possible to convey a short printing medium P even if a medium conveying unit is not provided between the separation position M2 and the fixing unit 17.

As described above, according to the present invention, it is possible to shorten the distance between the separation position M2 and the fixing position by bringing the fixing unit closer to the transfer member by the distance between the transfer position M1 and the separation position M2, whereby the size of the apparatus can be reduced. In addition, it becomes possible to use a short printing medium without using a conveying unit between the transfer member and the fixing unit.

Furthermore, by reducing the speed of the transfer member after the final end of the image writing region of the longest low-fixing-speed printing medium used in the apparatus has passed through the transfer position M1, the region of wastefully reducing the speed of the transfer member (produced in the case of using a short low-fixing-speed printing medium or when the image transfer portion is present only at an upper portion of the printing medium) is removed, whereby the output speed of the apparatus is increased. The final end of the image writing region may equal the final end of the printing medium.

By making the separation position of the printing medium from the transfer member equal the position of the border of the charge-removing region at the upstream side a distance L from the transfer position M1, it is possible to use a short printing medium, and therefore to greatly expand the range of printing media which can be used in a single image forming apparatus.

While the present invention has been described with respect to what are presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus, comprising:

a recording-medium carrying member rotating while carrying a recording medium;

image forming means for forming an image on the recording medium carried by said recording-medium carrying member;

driving means for driving said recording-medium carrying member at a first circumferential speed while the image is formed and at a second circumferential speed which is lower than the first circumferential speed; and fixing means for fixing the image on the recording medium, said fixing means being capable of fixing the image at a fixing speed which is lower than said first circumferential speed, wherein after the image has been formed on the recording medium, said driving means drives said recording-medium carrying means at the second circumferential speed.

2. An image forming apparatus according to claim 1, wherein said fixing speed equals said second circumferential speed.

3. An image forming apparatus according to claim 1, wherein said driving means switches from said first circumferential speed to said second circumferential speed while said recording-medium carrying member carries the recording medium.

4. An image forming apparatus according to claim 1, wherein said fixing means is capable of fixing the image at first and second fixing speeds.

5. An image forming apparatus according to claim 4, wherein said fixing means switches the fixing speed in accordance with a type of the recording material.

6. An image forming apparatus according to claim 1, further comprising:

an image bearing member for bearing the image; and transfer means for transferring the image on said image bearing member onto the recording medium.

7. An image forming apparatus, comprising:

an image bearing member for bearing an unfixed image;

a recording-medium carrying member moving while carrying a recording medium, the unfixed image on said image bearing member being transferred onto the recording medium carried by said recording-medium carrying means; and fixing means for fixing the image on the recording medium, said fixing means being capable of performing a fixing operation at a first fixing speed and a fixing operation at a second fixing speed different from said first fixing speed, wherein a moving speed of said recording-medium carrying member after the completion of the transfer operation differs between the fixing operation at said first fixing speed and the fixing operation at said second fixing speed.

8. An image forming apparatus according to claim 7, wherein said first fixing speed is lower than said second fixing speed, and wherein the moving speed of said recording-material carrying member is lower in the fixing operation at said first fixing speed than in the fixing operation at said second fixing speed.

9. An image forming apparatus according to claim 7, wherein the moving speed of said recording-material carrying member after the completion of the transfer operation equals the fixing speed.

10. An image forming apparatus according to claim 7, wherein said fixing means selects one of said first fixing speed and said second fixing speed in accordance with a type of the recording material.

11. An image forming apparatus according to claim 10, wherein a distance between a separation position of the recording medium from said recording-medium carrying member and a fixing position adjacent said fixing means is smaller than a length of a recording material for which said fixing means selects a slow fixing speed.

* * * * *